US007861553B2

(12) United States Patent
Ryoo

(10) Patent No.: US 7,861,553 B2
(45) Date of Patent: Jan. 4, 2011

(54) SUCTION PIPE ASSEMBLY AND MANUFACTURING METHOD THEREOF

(75) Inventor: Byung Hee Ryoo, Pyeongtaek-si (KR)

(73) Assignee: Korea Bundy Co., Ltd., Gyeonggi-do (KR)

( * ) Notice: Subject to any disclaimer, the term of this patent is extended or adjusted under 35 U.S.C. 154(b) by 282 days.

(21) Appl. No.: 12/249,967

(22) Filed: Oct. 13, 2008

(65) Prior Publication Data

US 2009/0288446 A1 Nov. 26, 2009

Related U.S. Application Data

(63) Continuation of application No. PCT/KR2008/004161, filed on Jul. 16, 2008.

(30) Foreign Application Priority Data

May 23, 2008 (KR) ..... 10-2008-0047808

(51) Int. Cl.
*F25B 41/00* (2006.01)

(52) U.S. Cl. ..... 62/513; 62/515

(58) Field of Classification Search ..... 62/513, 62/515, 259.1, 225; 165/172, 176, DIG. 454, 165/DIG. 455, DIG. 460; 29/890.035, 514, 29/DIG. 4

See application file for complete search history.

(56) References Cited

U.S. PATENT DOCUMENTS 2,521,040 A * 9/1950 Casetta ..... 62/509
4,087,987 A * 5/1978 Schumacher et al. ..... 62/276
4,910,972 A * 3/1990 Jaster ..... 62/335
6,485,957 B1 * 11/2002 Darrow et al. ..... 435/226
7,438,123 B2 * 10/2008 Tadokoro ..... 165/164
2004/0144130 A1 * 7/2004 Jung ..... 62/513
2005/0092011 A1 * 5/2005 Pereira et al. ..... 62/298
2005/0109486 A1 * 5/2005 Memory et al. ..... 165/62
2007/0215333 A1 * 9/2007 Viklund et al. ..... 165/172

* cited by examiner

*Primary Examiner*—Mohammad M Ali
(74) *Attorney, Agent, or Firm*—Nixon Peabody LLP; Jeffrey L. Costellia

(57) ABSTRACT

Provided is a suction pipe assembly with improved heat conductivity and a manufacturing method thereof. The suction pipe assembly includes a suction pipe, a capillary, a heat transmission pipe, and an adhesive agent. The suction pipe is disposed between a compressor and an evaporator and guides a refrigerant ejected from the evaporator to the compressor in a cooling system executing cooling by circulating the refrigerant and including the compressor, the condenser and the evaporator. The capillary is disposed between the condenser and the evaporator and guides the refrigerant ejected from the condenser to the evaporator. The heat transmission pipe includes the capillary inside and a contact portion for widening a contact area to the suction pipe outside to tightly contact the suction pipe. The adhesive agent is interposed between an external surface of the suction pipe and the contact portion to connect the heat transmission pipe with the suction pipe.

8 Claims, 5 Drawing Sheets

[Fig. 1]
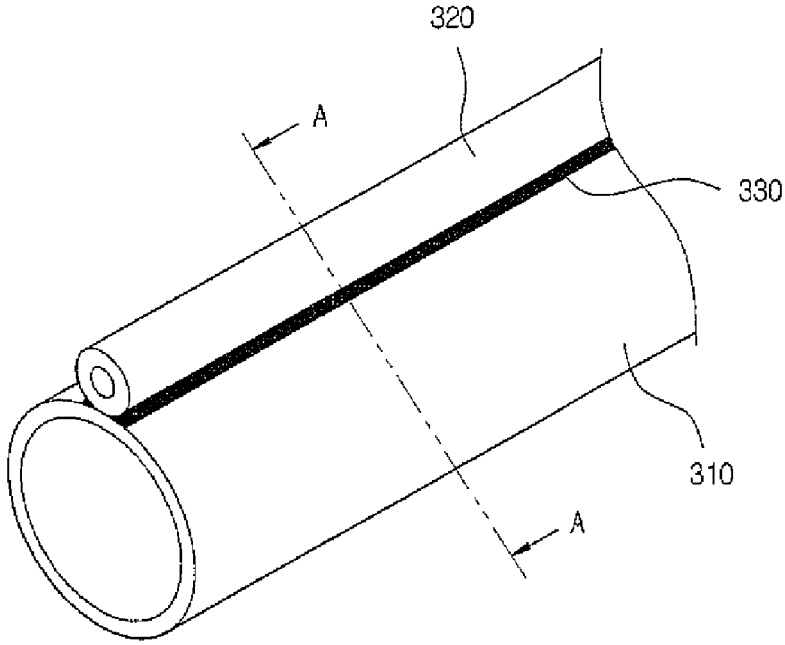
[Fig. 2]
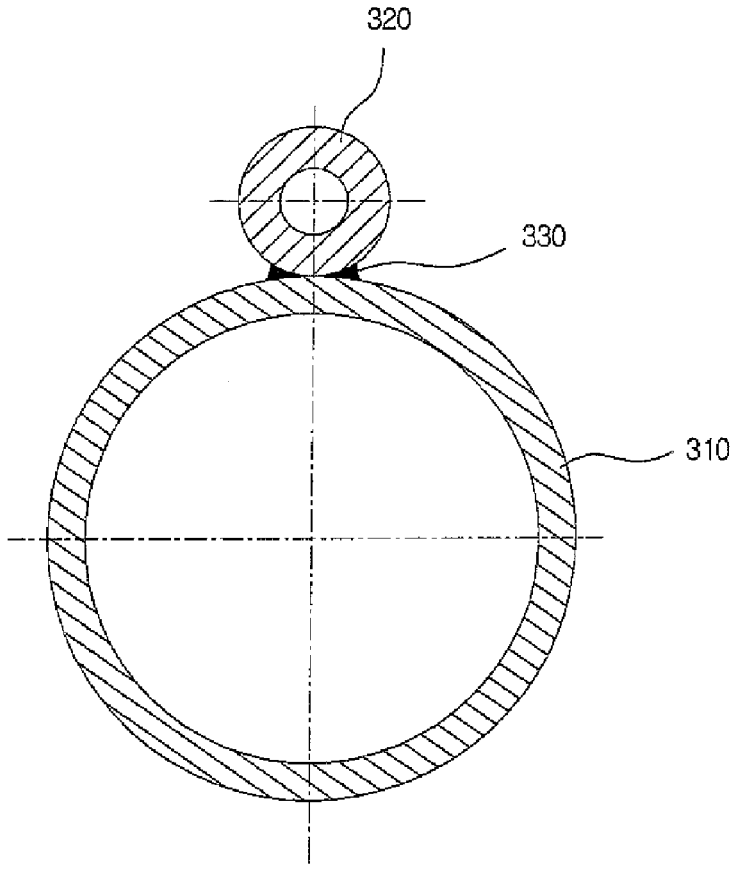

[Fig. 3]
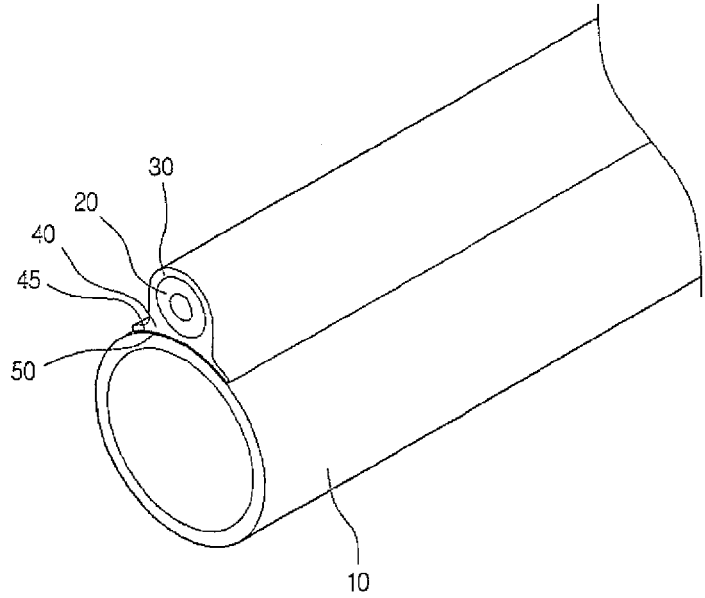
[Fig. 4]
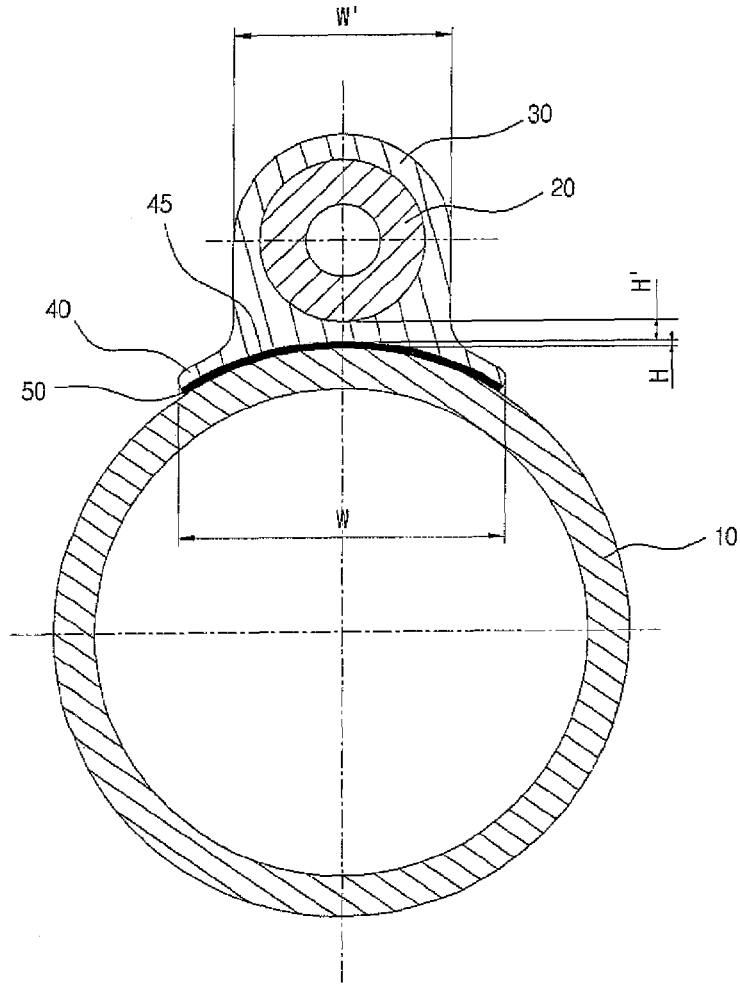

[Fig. 5]
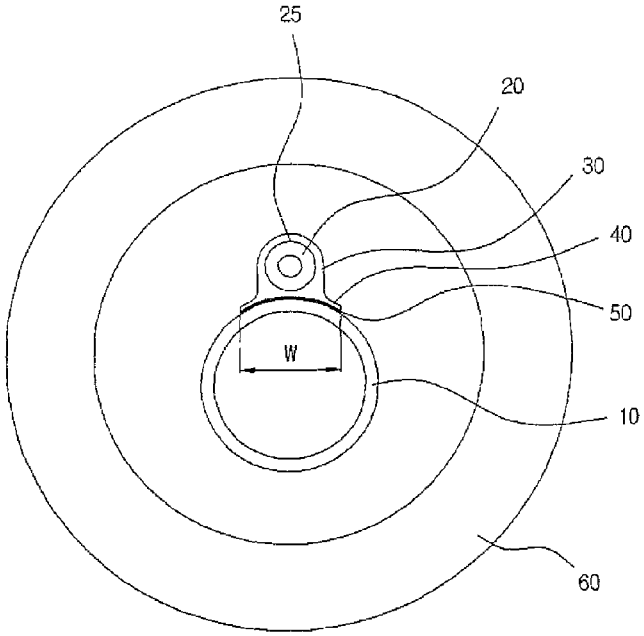
[Fig. 6]
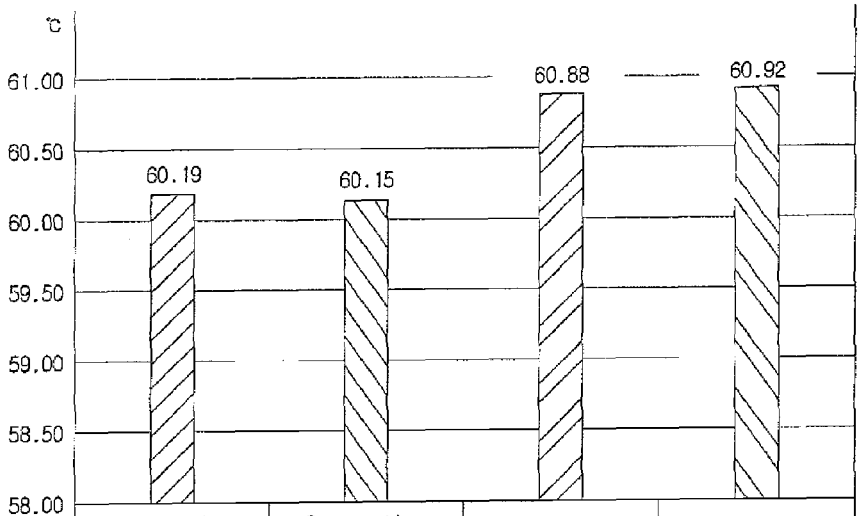
| | Comparative Example 1 | Comparative Example 2 | Example 1 | Example 2 |
|---|---|---|---|---|
| Temperature measured in thermometer(℃) | 60.19 | 60.15 | 60.88 | 60.92 |
| Average temperature(℃) | 60.17 | | 60.90(increased 1.2%) | |

[Fig. 7]
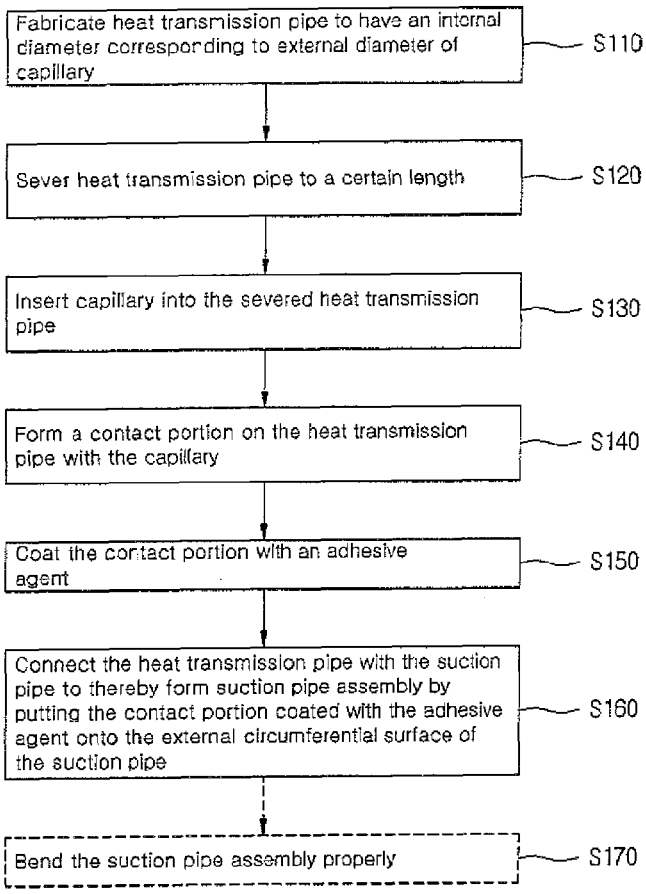
[Fig. 8]
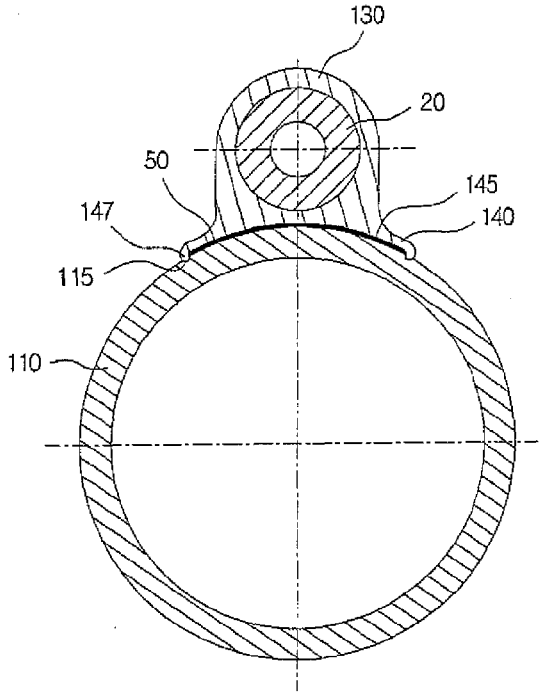

[Fig. 9]
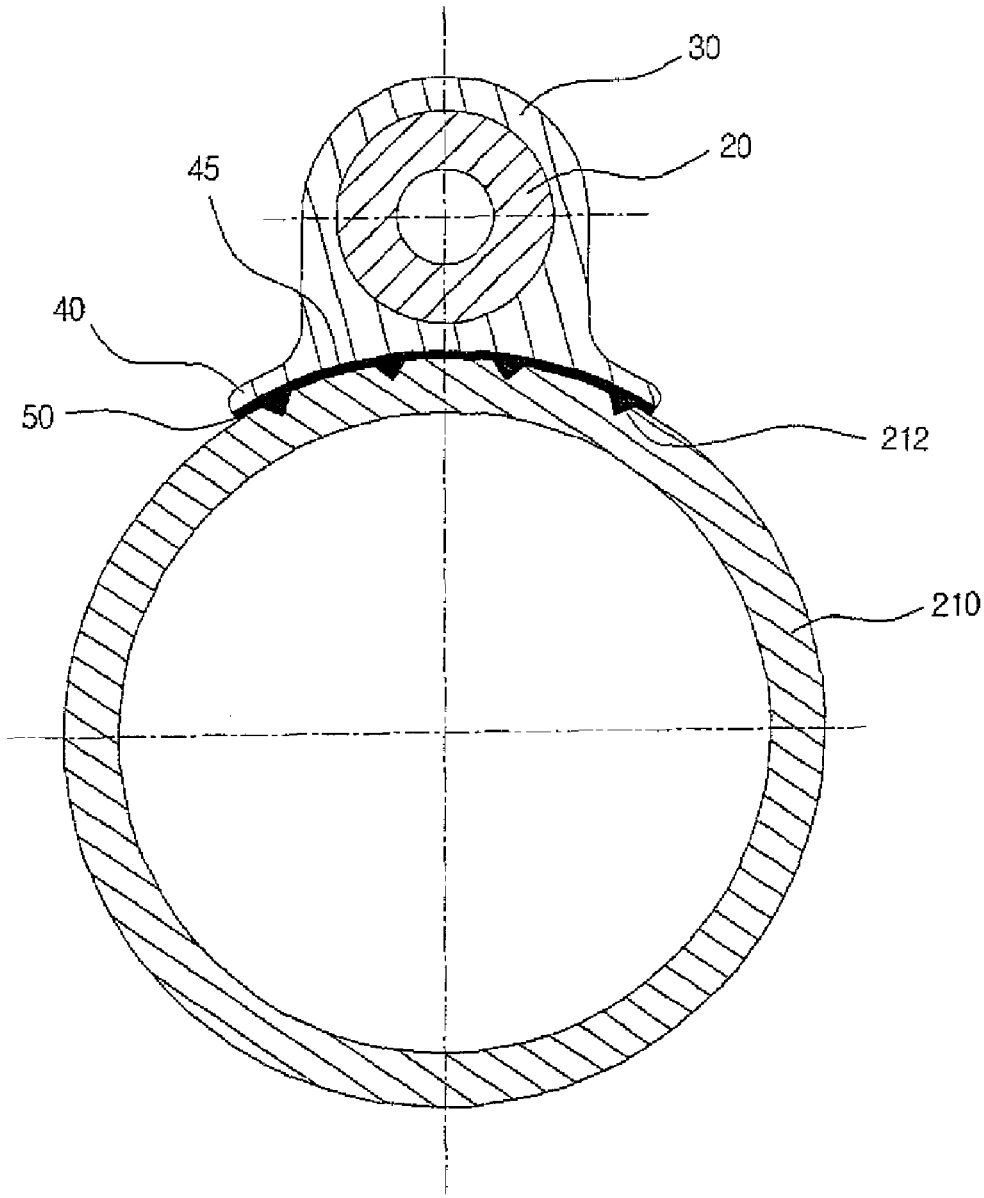

SUCTION PIPE ASSEMBLY AND MANUFACTURING METHOD THEREOF

CROSS REFERENCE TO RELATED APPLICATIONS

This application is a continuation of PCT/KR2008/004161 filed Jul. 16, 2008, which claims priority to KR 10-2008-0047808 filed on May 23, 2008, both of which are incorporated by reference.

TECHNICAL FIELD

The present invention relates to a suction pipe assembly and a method for manufacturing the same. More particularly, the present invention relates to a suction pipe assembly with improved heat conductivity and a method for manufacturing the suction pipe assembly.

BACKGROUND

Generally, refrigeration equipment stores or keeps food or articles at a cold temperature by circulating a refrigerant through a series of refrigeration cycles, which include compression, condensation, expansion and evaporation.

Herein, the refrigerant is compressed at a high temperature and pressure as it goes through a compressor operating on a power supply. The refrigerant is delivered to a condenser through a pipe connecting between the compressor and the condenser and thus it is liquefied.

The refrigerant becomes wet, saturated vapor as it goes through a capillary connected to the condenser and enters an evaporator.

The refrigerant absorbs evaporation latent heat as it moves through the evaporator and thus it is gasified. As the refrigerant is gasified, surrounding air is cooled down and this cools down or freezes a refrigerator or freezer.

Subsequently, the refrigerant becomes a low-temperature gas-phase refrigerant and it is ejected from the evaporator through a suction pipe. The ejected low-temperature gas-phase refrigerant enters the compressor and becomes high-temperature and high-pressure vapor and repeats the cycle.

Herein, to help heat exchange between the suction pipe and the refrigerant transferring into the capillary, the suction pipe contacts part of the capillary to thereby form a suction pipe assembly.

FIG. 1 is a perspective view showing a conventional suction pipe assembly, and FIG. 2 is a cross-sectional view of the suction pipe assembly of FIG. 1 cut along an A-A line.

Referring to FIGS. 1 and 2, the conventional suction pipe assembly includes a suction pipe 310 and a capillary 320 whose external side surfaces contact each other in a longitudinal direction.

The suction pipe 310 and the capillary 320 may be combined at a portion 330 through a technique such as welding.

As welding, brazing or soldering may be used to combine the suction pipe 310 and the capillary 320. The soldering is usually performed using tin (Sn).

Also, to improve the heat exchange between the suction pipe 310 and the capillary 320 and corrosion-resistance thereof, the suction pipe 310 and the capillary 320 are usually formed of copper.

DISCLOSURE

Technical Problem

However, the conventional suction pipe assembly has the following shortcomings.

First, as the external surface of the suction pipe and the capillary are formed in circumferential shapes, the suction pipe and the capillary contact each other only at a line. Accordingly, a heat transmission area is reduced and thus heat cannot be transferred effectively.

Second, as the contact portion between the suction pipe and the capillary of the suction pipe assembly becomes long, it becomes difficult to uniformly and finely weld the contact portion. Thus, the work efficiency degrades and uniform welding quality can hardly be secured.

Third, since the suction pipe, which has a relatively greater caliber than the capillary, is formed of copper, production costs increases, which also leads to an increase in equipment employing the suction pipe.

Technical Solution

An embodiment of the present invention devised to resolve the above problems is directed to providing a suction pipe assembly with improved heat conductivity and a method for manufacturing the same.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an aspect of the present invention, there is provided a suction pipe assembly, including: a suction pipe disposed between a compressor and an evaporator for guiding a refrigerant ejected from the evaporator to a compressor in a cooling system including the compressor, the condenser and the evaporator and executing cooling by circulating the refrigerant; a capillary disposed between the condenser and the evaporator for guiding the refrigerant ejected from the condenser to the evaporator; a heat transmission pipe including the capillary inside and including a contact portion for widening a contact area to the suction pipe outside, the heat transmission pipe tightly contacting an external circumferential surface of the suction pipe; and an adhesive agent interposed between an external surface of the suction pipe and the contact portion to connect the heat transmission pipe with the suction pipe.

The contact portion may be formed on the external circumferential surface of the suction pipe, and a width of the contact portion may not be shorter than an external diameter of the heat transmission pipe.

The contact portion further may include protrusions at both ends in a longitudinal direction of the contact portion and the protrusions may be housed by connection grooves formed in the suction pipe corresponding to the protrusions.

The suction pipe may be formed of any one between steel and aluminum.

The suction pipe may be formed of steel and plated with a corrosion-resistant material, and the corrosion-resistant plating may be at least any one selected from the group of hot dip galvanizing, molten zinc-trivalent chrome plating, SeAHLume plating, and SeAHLume-trivalent chrome plating.

The heat transmission pipe is formed of aluminum.

The adhesive agent may be a heat conductive material including a hardener and filler, and the filler may include any one selected from the group consisting of copper powder, aluminum powder, carbon black and ceramic.

In accordance with another aspect of the present invention, there is provided a method for manufacturing a suction pipe assembly, the method including fabricating a heat transmission pipe having an internal diameter corresponding to an external diameter of a capillary by using a drawing method, severing the heat transmission pipe in a certain length, inserting the capillary into the heat transmission pipe, forming a contact portion on the heat transmission pipe with the capillary inserted thereto, coating the contact portion with an adhesive agent, and connecting the heat transmission pipe with the suction pipe by putting the contact portion coated with the adhesive agent onto the external circumferential surface of the suction pipe.

ADVANTAGEOUS EFFECTS

The suction pipe assembly and a manufacturing method thereof according to the present invention have the following effects.

First, since one side of the heat transmission pipe is formed as a contact portion of a shape corresponding to the external circumferential surface of the suction pipe, the heat transmission pipe tightly contacts the suction pipe to thereby increase the contact area to the suction pipe. With the increased contact area, heat transmission can be performed more effectively between a refrigerant transferring to the inside of the suction pipe and a refrigerant transferring to the inside of the capillary inserted into the heat transmission pipe.

Second, as the capillary is tightly inserted into the heat transmission pipe, the same effect as the external circumferential area of the capillary increases can be acquired. Thus, the heat transmission efficiency through the capillary can be improved.

Third, the heat transmission pipe and the suction pipe are stuck to each other by an adhesive agent, which is formed of a heat conductive material. Thus, it is possible to prevent the heat conductivity between the suction pipe and the heat transmission pipe from being degraded.

Fourth, since the suction pipe may be formed of not only copper or aluminum but also steel, which is relatively inexpensive, it is economical to produce the suction pipe assembly. Although the suction pipe may be formed of steel, the external surface of the suction pipe may be plated with a corrosion-resistant material. Thus, it is possible to acquire a corrosion-resistance proper for commercial use.

Fifth, both ends of the contact portion further include a protrusion, individually, and the external circumferential surface of the suction pipe further includes a connection groove corresponding to the protrusion. The protrusions are inserted to and fixed firmly with the connection grooves, respectively. Therefore, the heat transmission pipe can be more easily connected to the suction pipe to thereby improve work efficiency. Also, since the distance between the contact portion and the suction pipe can be maintained uniformly, the thickness of the adhesive agent applied thereto can be kept uniform. Therefore, the adhesiveness and heat conductivity can be managed.

While the present invention has been described with respect to the specific embodiments, it will be apparent to those skilled in the art that various changes and modifications may be made without departing from the spirit and scope of the invention as defined in the following claims.

BRIEF DESCRIPTION OF THE DRAWINGS

FIG. 1 is a perspective view showing a conventional suction pipe assembly.

FIG. 2 is a cross-sectional view illustrating the suction pipe assembly of FIG. 1 cut along an A-A line.

FIG. 3 is a perspective view describing a suction pipe assembly in accordance with Example 1 of the present invention.

FIG. 4 is a cross-sectional view illustrating the suction pipe assembly of the Example 1.

FIG. 5 exemplarily shows a heat transmission performance of the suction pipe assembly of the Example 1.

FIG. 6 is a table showing a heat transmission performance result of the suction pipe assembly of the Example 1.

FIG. 7 is a flowchart describing a process of manufacturing the suction pipe assembly of the Example 1.

FIG. 8 is a cross-sectional view illustrating a suction pipe assembly in accordance with Example 2 of the present invention.

FIG. 9 is a cross-sectional view illustrating a suction pipe assembly in accordance with Example 3 of the present invention.

BEST MODE FOR THE INVENTION

The advantages, features and aspects of the invention will become apparent from the following description of the embodiments with reference to the accompanying drawings, which is set forth hereinafter.

FIG. 3 is a perspective view describing a suction pipe assembly in accordance with Example 1 of the present invention FIG. 4 is a cross-sectional view illustrating the suction pipe assembly of the Example 1.

As shown in FIGS. 3 and 4, the suction pipe assembly includes a suction pipe 10, a capillary 20, a heat transmission pipe 30, and an adhesive agent 50. Herein, the capillary 20 is inserted into the inside of the heat transmission pipe 30 to a certain length. On the outside of the heat transmission pipe 30, a contact portion 40 is formed in a shape corresponding to the external circumferential surface of the suction pipe 10. As the contact portion 40 is tightly connected to an external circumferential surface of the suction pipe 10, the heat transmission pipe 30 is combined with the suction pipe 10. As the suction pipe 10, the heat transmission pipe 30 and the capillary 20 contact each other due to the connection, not only can heat be transmitted but also heat conductivity is improved because the contact area between the heat transmission pipe 30 and the suction pipe 10 widens owing to the presence of the contact portion 40. Meanwhile, the adhesive agent 50 for providing adhesiveness to the heat transmission pipe 30 and the suction pipe 10 may be interposed between the contact portion 40 and the external surface of the suction pipe 10. The adhesive agent 50 may be formed of a heat conductive material. Thus, the adhesive agent 50 not only provides adhesiveness between the heat transmission pipe 30 and the suction pipe 10 but also minimizes a decrease in a heat transmission efficiency caused by the refrigerant transferring to the suction pipe 10 and the refrigerant transferring to the capillary 20.

To be specific, the suction pipe assembly may include the suction pipe 10, the capillary 20, the heat transmission pipe 30, and the adhesive agent 50.

Herein, the capillary 20 may be a typical capillary that is mounted between a condenser and an evaporator and guide the transfer of the refrigerant ejected from the condenser to enter the evaporator.

The capillary 20 may be formed of copper, but the present invention is not limited to forming the capillary 20 of copper and it may be formed of diverse materials such as aluminum (Al) and steel.

The capillary 20 may be inserted to the inside of the heat transmission pipe 30.

To house the capillary 20, the heat transmission pipe 30 may be formed in a shape of a pipe, and the heat transmission pipe 30 is formed to have its internal diameter corresponding to the external diameter of the capillary 20.

Accordingly, the capillary 20 can tightly contact the heat transmission pipe 30 to be integrated with the heat transmission pipe 30. Consequently, an effect that the external surface of the capillary 20 widens is brought about and thus the heat is transmitted through the capillary 20 more efficiently.

The contact portion 40 may be formed in a part of the external surface of the heat transmission pipe 30.

The contact portion 40 is formed in a longitudinal direction of the heat transmission pipe 30, and a contact surface 45 of a shape corresponding to the external circumferential surface of the suction pipe 10 may be formed to have a certain width (W).

Herein, the width (W) of the contact portion 40 formed by the contact surface 45 may be formed wider than an external diameter (W') of the heat transmission pipe 30 in order to widen the contact area by surface contacting with the external circumferential surface of the suction pipe 10.

Therefore, heat transmission between the suction pipe 10 and the heat transmission pipe 30 occurs in a wide area. As a result, the heat conductivity through the heat transmission pipe 30 is improved.

Meanwhile, the contact surface 45 may be coated with the adhesive agent 50. The adhesive agent 50 on the contact surface 45 is brought to the suction pipe 10 and adheres to it. As a result, the heat transmission pipe 30 is connected to the suction pipe 10.

Herein, the adhesive agent 50 may be formed of a heat conductive material in such a way as to not obstruct the heat transmission performance between the heat transmission pipe 30 and the suction pipe 10.

Not to negatively affect the heat transmission, the adhesive agent 50 may be formed of a hardener and filler. To secure heat conductivity, the filler may be one selected from the group consisting of copper powder, aluminum powder, carbon black, and ceramic.

The adhesive agent 50 may be a typical adhesive agent used to putting an object onto something with no regard to a hardener or filler.

The adhesive agent 50 interposed between the suction pipe 10 and the contact surface 45 provides enough adhesive strength that the heat transmission pipe 30 substantially adheres to the suction pipe 10. The adhesive agent 50 is applied in a thickness (H) minimizing its hindrance to the heat transmission that may be caused by the adhesive agent 50.

Herein, the thickness of the adhesive agent 50 which can provide a sufficient adhesive strength that the heat transmission pipe 30 substantially adheres to the suction pipe 10 and minimizes the hindrance to the heat transmission may range from approximately 0.005 mm to approximately 0.015 mm.

Meanwhile, the contact portion 40 may be formed in a thickness (H') that can help the heat transmission through the contact portion 40 while minimizing heat loss of the capillary 20 and the suction pipe 10. The thickness (H') of the contact portion 40 may range from approximately 0.04 mm to approximately 0.07 mm.

The heat transmission pipe 30 may be formed of aluminum but the present invention is not limited to it and diverse materials can be used to form the heat transmission pipe 30.

Meanwhile, the suction pipe 10 is disposed between a compressor and an evaporator in a cooling system executing refrigeration by circulating a refrigerant and including a compressor (not shown), a condenser (not shown) and an evaporator (not shown). The suction pipe 10 may be a typical suction pipe for guiding the refrigerant ejected from the evaporator to the compressor.

The suction pipe 10 may be formed of at least any one selected from steel, aluminum, copper and combinations thereof. When the suction pipe 10 is formed of steel, it may be plated with a corrosion-resistant material.

When the suction pipe 10 is formed of steel, processing and bending characteristics of the suction pipe 10 are improved. Thus, work efficiency may be improved due to easy processing. Since steel is relatively cheaper than aluminum or copper, economical efficiency of production is improved as well.

Although the suction pipe 10 is formed of steel, there is no concern about corrosion because the steel suction pipe 10 is plated with a corrosion-resistant material.

The corrosion-resistant plating may be at least any one selected from hot dip galvanizing, molten zinc-trivalent chrome plating, SeAHLume plating, and SeAHLume-trivalent chrome plating.

The molten zinc-trivalent chrome plating is a plating method that an object is plated with molten zinc and then chromated with trivalent chrome ($Cr^{3+}$).

The SeAHLume plating is performed including approximately 55 wt % aluminum, approximately 43.4 to approximately 44.9 wt % zinc, and some inevitable impurities. The SeAHLume-trivalent chrome plating is a method that an object is plated with SeAHLume and then chromated with trivalent chrome ($Cr^{3+}$).

FIG. 5 exemplarily shows a heat transmission performance of the suction pipe assembly of the Example 1, and FIG. 6 is a table showing a heat transmission performance result of the suction pipe assembly of the Example 1.

As shown in FIGS. 5 and 6, heat source is applied to the inside of the suction pipe 10 which connectively contacts the heat transmission pipe 30 through the adhesive agent 50.

Herein, an adiabatic material 60 is provided in the outside of the suction pipe 10 and the heat transmission pipe 30 to prevent the applied heat source from being emitted into the atmosphere as much as possible.

Subsequently, temperature was measured in a thermometer 25, which was disposed in the upper part of the capillary 20 at the farthest from the suction pipe 10, and the measured temperature was compared with temperature of the heat source applied to the suction pipe 10.

Heat transmission performance experimental conditions of the suction pipe assembly were as follows.

First, the suction pipe 10 used in Examples 1 and 2 was formed of steel and had an external diameter of approximately 6.35 mm, thickness of approximately 0.5 mm, and length of approximately 1,314 mm.

The capillary 20 was formed of copper and had an external diameter of approximately 1.8 mm, thickness of approximately 0.625 mm, and length of approximately 2,700 mm.

The heat transmission pipe 30 was formed of aluminum.

A test chamber (not shown) where the suction pipe assembly and the adiabatic material 60 were set up was maintained to have an internal temperature of approximately 30° C. at humidity of approximately 60%.

Also, an antifreezing solution of approximately 62.2° C. was used as the heat source applied to the inside of the suction pipe 10.

Meanwhile, in Comparative Examples 1 and 2, the same adiabatic material used in the above Examples 1 and 2 was used, and the heat source was applied at the same temperature. Also, the suction pipe and the capillary had the same diameter, thickness and length as the suction pipe 10 and the capillary 20, but they were all formed of copper. The suction pipe and the capillary were connected to each other through tin (Sn) soldering in the suction pipe assembly, and the temperature was measured in the upper part of the capillary.

An average temperature of the temperatures measured in the Comparative Examples 1 and 2 was defined as 100%, which is a reference value. Then, an average temperature of the temperatures measured in the Examples 1 and 2 was presented as a percentage (%) value to the reference value.

When the measured temperatures of the Examples are over the reference value, it means that the suction pipe assembly is commercially acceptable.

The experiment result was as follows. The measured temperature of the Comparative Example 1 was 60.19° C., and the measured temperature of the Comparative Example 2 was 60.15° C. The average temperature of the Comparative Examples 1 and 2 was 60.17° C.

The measured temperature of the Example 1 was 60.88° C., and the measured temperature of the Example 2 was 60.92° C. The average temperature of the Examples 1 and 2 was 60.90° C.

Therefore, when the average temperature 60.17° C. of the Comparative Examples was set as 100%, it could be seen that the average temperature of the Examples was increased 1.2%.

According to the experiment, the width of the soldering used in the Comparative Examples was between approximately 1.4 mm to approximately 1.6 mm. When the width of the soldering was approximately 1.5 mm, the heat transmission area formed in the 1,314 mm-long suction pipe was 1,971 $mm^2$. The width (W) of the contact portion used in the Examples was between approximately 3.3 mm to approximately 3.7 mm. When the width of the contact portion was approximately 3.5 mm, the heat transmission area formed in the 1,314 mm-long suction pipe was 4,599 $mm^2$. The experiment result reveals that the heat transmission area of the Examples was increased approximately 2.3 times as much as that of the Comparative Examples.

To sum up, since the width (W) of the contact part 40 used in the Examples was wider than the width of the soldering used in the Comparative Examples, the heat transmission area on the suction pipe 10 increases, which leads to an improvement in heat transmission efficiency.

In conclusion, the transmission pipe 30 is regarded commercially acceptable due to the improved heat transmission efficiency.

FIG. 7 is a flowchart describing a process of manufacturing the suction pipe assembly of the Example 1.

Referring to FIG. 1, in step S110, a heat transmission pipe having an internal diameter that corresponds to the external diameter of a capillary was fabricated by using a drawing technique so that the capillary can be inserted into the inside of the heat transmission pipe.

In step S120, the heat transmission pipe is severed to a certain length corresponding to the length of the capillary to tightly contact the suction pipe.

In step S130, the capillary is inserted into the inside of the severed heat transmission pipe.

In step S140, a contact portion is formed on the external surface of the heat transmission pipe with the capillary inserted thereto.

The contact portion may be formed through a molding process such as roll forming. However, the present invention is not limited to the molding method and other diverse and proper processing methods may be applied to form the contact portion.

In step S150, the contact portion is coated with an adhesive agent.

In step S160, the contact portion coated with the adhesive agent adheres to the external circumferential surface of the suction pipe to thereby connect the heat transmission pipe with the suction pipe. Through the process, the suction pipe assembly of the Example 1 was manufactured.

Meanwhile, the suction pipe may be connected to the heat transmission pipe by applying the adhesive agent to the external circumferential surface of the suction pipe and putting the contact portion onto the adhesive agent. Otherwise, they may be connected to each other by coating both external circumferential surface of the suction pipe and contact portion and putting them together.

In step S170, the suction pipe assembly manufactured as above may be bent appropriately to correspond to the shape of a place and space where the suction pipe assembly is set up.

MODE FOR THE INVENTION

FIG. 8 is a cross-sectional view illustrating a suction pipe assembly in accordance with the Example 2 of the present invention. The suction pipe assembly of the Example 2 includes protrusions formed at both ends of the contact portion and connection grooves formed on the external circumferential surface of the suction pipe to correspond to the protrusions. Since the other constituent elements are the same as those of the Example 1, detailed description on the common constituent elements will not be provided.

Referring to FIG. 8, protrusions 147 are formed on both ends of the contact portion 140 mounted on a heat transmission pipe 130 with a capillary 20 inserted thereto.

Herein, the protrusions 147 are formed in the longitudinal direction of the contact portion 140.

The suction pipe 110 includes connection grooves 115 formed corresponding to the protrusions 147 and housing the protrusions 147.

The connection grooves 115 and the protrusions 147 help ease the adhesion work by preventing the heat transmission pipe 130 from moving when the heat transmission pipe 130 adheres to the suction pipe 110. Also, they make the suction pipe 110 and the heat transmission pipe 130 adhere to each other in a fine shape.

Also, the protrusions 147 bind the adhesive agent 50 between a contact surface 145 and the suction pipe 110 so that the adhesive agent 50 is not pushed out of the contact portion 140. Thus, the connection grooves 115 and the protrusions 147 suppress unnecessary loss of the adhesive agent 50.

The protrusions 147 and the connection grooves 115 may be formed to make the gap between the contact surface 145 and the suction pipe 110 range from approximately 0.005 mm to approximately 0.015 mm while the protrusions 147 are engaged with the connection grooves 115.

Then, the adhesive agent 50 applied between the contact surface 145 and the suction pipe 110 may be automatically maintained in a uniform thickness at a height of approximately 0.005 mm to approximately 0.015 mm.

FIG. 9 is a cross-sectional view illustrating a suction pipe assembly in accordance with Example 3 of the present invention. The suction pipe assembly of the Example 3 includes grooves 212 on the external circumferential surface of the suction pipe. The other constituent elements are the same as those of the Example 1.

Referring to FIG. 9, more than one groove 212 may be formed on a portion of the external surface of the suction pipe 210.

Herein, the groove 212 may be formed on a portion where the contact surface 45 formed in the heat transmission pipe 30 adheres using the adhesive agent 50.

The area where the grooves 212 are formed on the external circumferential surface of the suction pipe 210 may correspond to the area of the contact surface 45.

The grooves 212 may be formed on the external surface of the suction pipe 210 to have a certain width and depth. They may be formed in the longitudinal direction of the suction pipe 210, or they may be formed in a circumferential direction of the suction pipe 210.

Also, the grooves 212 may be formed in a net shape but they are not limited to a specific shape or pattern.

The grooves 212 may be formed through a physical or chemical process. For example, they may be physically formed on the surface of the suction pipe 210 through a molding process such as roll forming, or they may be chemically formed through an etching process.

The grooves 212 can prevent the adhesive agent 50 from running down on the external surface of the suction pipe 210 by letting the adhesive agent 50 permeate into the grooves 212. Through this process, the coating of the adhesive agent 50 can be performed stably and the coated state can be maintained fine.

Also, the adhesive agent 50 applied between the suction pipe 210 and the contact surface 45 permeates into the grooves 212 to thereby increase the adhesion strength between the adhesive agent 50 and the suction pipe 210.

What is claimed is:

1. A suction pipe assembly, comprising:

a suction pipe disposed between a compressor and an evaporator for guiding a refrigerant ejected from the evaporator to a compressor in a cooling system including the compressor, the condenser and the evaporator and executing cooling by circulating the refrigerant;

a capillary disposed between the condenser and the evaporator for guiding the refrigerant ejected from the condenser to the evaporator; and, a heat transmission pipe including the capillary inside and including a contact portion surface contacting with the suction pipe outside for widening a contact area to the suction pipe outside, the heat transmission pipe tightly contacting an external circumferential surface of the suction pipe, wherein the external circumferential surface of the suction pipe and the contact portion is connected each other by one of welding, soldering, brazing, an adhesive agent, a heat shrinkable tube and a tape.

2. The suction pipe assembly of claim 1, wherein the contact portion is formed on the external circumferential surface of the suction pipe, and a width of the contact portion is not shorter than an external diameter of the heat transmission pipe.

3. The suction pipe assembly of claim 2, wherein the contact portion further includes protrusions at both ends in a longitudinal direction of the contact portion and the protrusions are housed by connection grooves formed in the suction pipe corresponding to the protrusions.

4. The suction pipe assembly of claim 1, wherein the suction pipe is formed of any one between steel and aluminum.

5. The suction pipe assembly of claim 4, wherein the suction pipe is formed of steel and plated with a corrosion-resistant material, and the corrosion-resistant plating is at least any one selected from the group of hot dip galvanizing, molten zinc-trivalent chrome plating, SeAHLume plating, and SeAHLume-trivalent chrome plating.

6. The suction pipe assembly of claim 1, wherein the heat transmission pipe is formed of aluminum.

7. The suction pipe assembly of claim 1, wherein the adhesive agent is a heat conductive material including a hardener and filler, and the filler includes any one selected from the group consisting of copper powder, aluminum powder, carbon black and ceramic.

8. A method for manufacturing a suction pipe assembly, comprising:

fabricating a heat transmission pipe having an internal diameter corresponding to an external diameter of a capillary by using a drawing method;

severing the heat transmission pipe in a certain length;

inserting the capillary into the heat transmission pipe;

forming a contact portion on the heat transmission pipe with the capillary inserted thereto; and, connecting the contact portion to an external circumferential surface of a suction pipe by one of welding, soldering, brazing, an adhesive agent, a heat shrinkable tube and a tape.

* * * * *